United States Patent [19]

Simone

[11] 4,405,439

[45] Sep. 20, 1983

[54] REMOVAL OF QUINOLINE INSOLUBLES FROM COAL DERIVED FRACTIONS

[75] Inventor: Andre A. Simone, Dover, N.J.

[73] Assignee: The Lummus Company, Bloomfield, N.J.

[21] Appl. No.: 243,484

[22] Filed: Mar. 13, 1981

Related U.S. Application Data

[60] Division of Ser. No. 60,453, Jul. 25, 1979, which is a continuation of Ser. No. 819,772, Jul. 28, 1977, abandoned.

[51] Int. Cl.[3] ..... C10C 1/18; C10C 3/08

[52] U.S. Cl. ..... 208/45

[58] Field of Search ..... 208/45

[56] References Cited

U.S. PATENT DOCUMENTS

| | | | |
|---|---|---|---|
| 1,553,641 | 9/1925 | Sperr, Jr. | 208/45 |
| 3,147,205 | 9/1964 | Ohsol et al. | 208/45 |
| 3,761,387 | 9/1973 | Weegner et al. | 208/45 |
| 3,992,281 | 11/1976 | Benade | 208/45 |
| 4,127,472 | 11/1978 | Migitaka et al. | 208/45 |
| 4,259,171 | 3/1981 | Stadelhofer et al. | 208/45 |
| 4,277,325 | 7/1981 | Greenwood | 2208/45 |

FOREIGN PATENT DOCUMENTS

| | | | |
|---|---|---|---|
| 1124204 | 8/1968 | United Kingdom | 208/45 |
| 1295788 | 12/1971 | U.S.S.R. | 208/45 |

*Primary Examiner*—Delbert E. Gantz
*Assistant Examiner*—Helane E. Maull
*Attorney, Agent, or Firm*—Elliot M. Olstein; Louis E. Marn

[57] ABSTRACT

Coal tar pitch is contacted with a promoter liquid having a 5 volume percent distillation temperature of at least 250° F. and a 95 volume percent distillation temperature of at least 350° F. and no greater than about 750° F. with the liquid having a characterization factor of at least 9.75 to promote the separation of quinoline insolubles from the pitch. A coat tar pitch fraction essentially free of quinoline insolubles is then subjected to coking to produce a needle coke. The process is also applicable to separation of quinoline insolubles from coal tar derived binder pitch.

5 Claims, 1 Drawing Figure

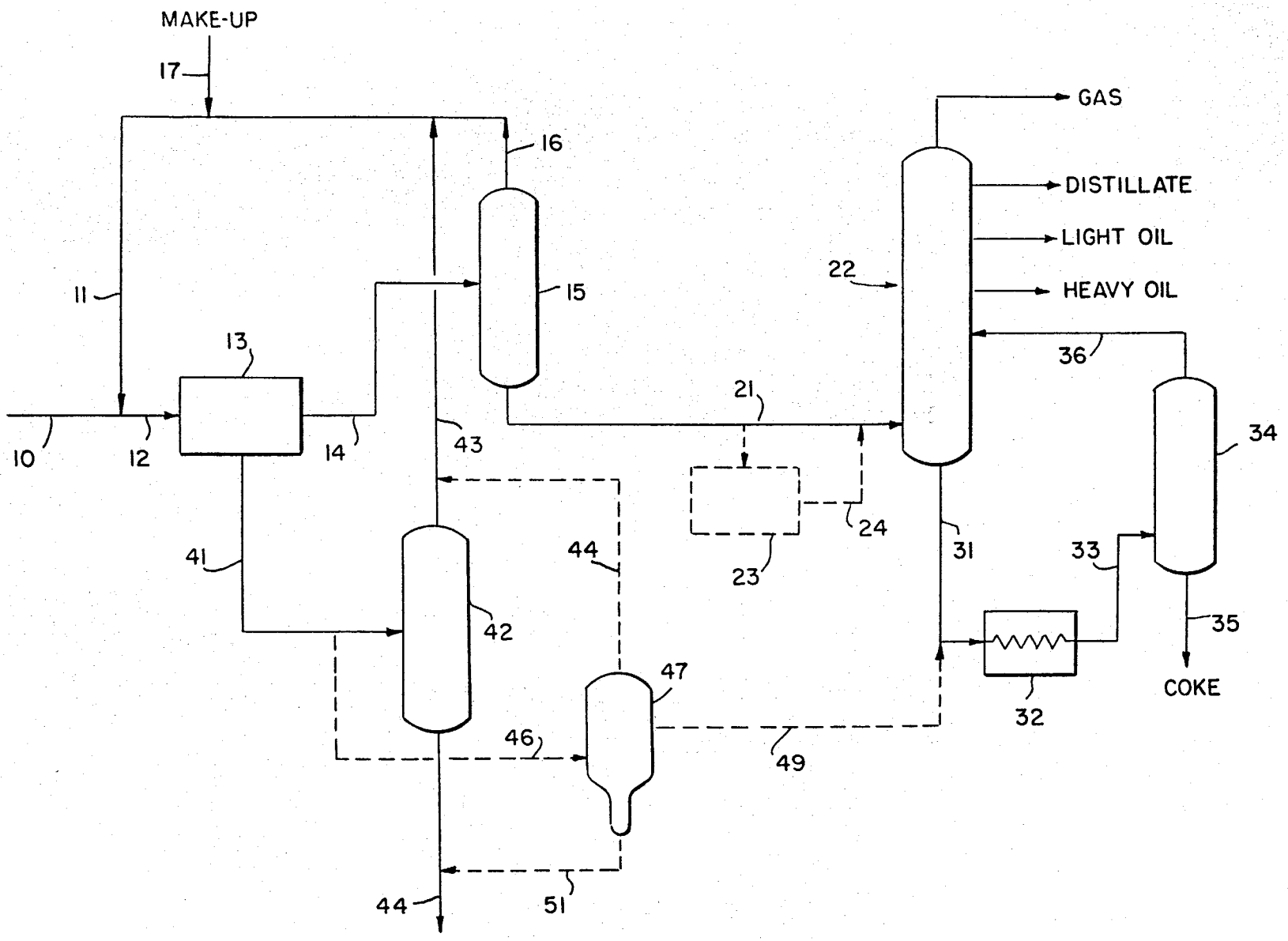
GAS
DISTILLATE
LIGHT OIL
HEAVY OIL
COKE
MAKE-UP
10
11
12
13
14
15
16
17
21
22
23
24
31
32
33
34
35
36
41
42
43
44
46
47
49
51

REMOVAL OF QUINOLINE INSOLUBLES FROM COAL DERIVED FRACTIONS

This is a division, of application Ser. No. 60,453, filed on July 25, 1979 which is a continuation of Ser. No. 819,772 filed on July 28, 1977 now abandoned.

This invention relates to the production of needle coke, and more particularly, to a new and improved process for producing needle coke from coal tar pitch. Needle coke, after calcination and graphitization, is characterized by a low longitudinal coefficient of thermal expansion which is matched by a low electric resistivity and such needle coke is primarily used in producing high quality synthetic graphite electrodes for electrosteel furnaces and for other electrothermal and chlor-alkali industries.

In accordance with the present invention, coal tar pitch is contacted with a liquid promoter which promotes and enhances the separation of non-crystalline substances from the pitch in order to recover a coal tar pitch fraction having a reduced quantity of such non-crystalline substances. Such fraction is then subjected to coking conditions of temperature and pressure to produce a needle coke.

In accordance with another embodiment, coal tar derived binder pitch is contacted with a liquid promoter which promotes and enhances the separation of non-crystalline substances (measured as quinoline insolubles) from the binder pitch in order to recover a binder pitch fraction having a reduced quantity of such quinoline insolubles.

The liquid which is employed to enhance and promote the separation of non-crystalline substances is generally a hydrocarbon liquid having a characterization factor (K) of at least about 0.75 and preferably less than 12.0 wherein:

$$K = \sqrt[3]{\frac{T_B}{G}}$$

wherein $T_B$ is the motal average boiling point of the liquid (°R); and G is specific gravity of the liquid (60° F./60° F.).

The characterization factor is an index of the aromaticity/parafinicity of hydrocarbons and petroleum fractions as disclosed by Watson & Nelson Ind. Eng. Chem. 25 880 (1933), with more parafinic materials having higher values for the characterization factor (K). The promoter liquid which is employed is one which has a characterization factor (K) in excess of 9.75.

The following Table provides representative characterization Factors (K) for various materials:

TABLE

| | |
|---|---|
| Anthracene | 8.3 |
| Naphthalene | 8.4 |
| 425-500° F. Coal Tar Distillate | 8.8 |
| 550-900° F. Coal Tar Distillate | 9.1 |
| 600-900° F. Coal Tar Distillate | 9.0 |
| 400-450° F. Coal Tar Distillate | 9.4 |
| Benzene | 9.8 |
| Tetrahydronaphthalene | 9.8 |
| o-xylene | 10.3 |
| Decahydronaphthalene | 10.6 |
| Cyclohexane | 11.0 |
| 425-500° F. Boiling Range Kerosene | 11.3 |
| n-Dodecylbenzene | 12.0 |
| Propylene Oligomers (pentamer) | 12.2 |

TABLE-continued

| | |
|---|---|
| Cetene | 12.8 |
| Tridecane | 12.8 |
| n-Hexane | 12.9 |
| Hexadecane or octane | 13.0 |

The liquid which is used to enhance and promote the separation of non-crystalline substances is further characterized by a 5 volume percent distillation temperature of at least about 250° F. and a 95 volume percent distillation temperature of at least 350° F. and no greater than about 750° F. The promoter liquid preferably has a 5 volume percent distillation temperature of at least about 310° F. and most preferably of at least about 400° F. The 95 volume percent distillation temperature is preferably no greater than about 600° F. The most preferred promoter liquid has a 5 volume percent distillation temperature of at least about 425° F. and a 95 volume percent distillation temperature of no greater than about 500° F. It is to be understood that the promoter liquid may be a hydrocarbon, e.g., tetrahydronaphthalene, in which case the 5 volume percent and 95 volume percent distillation temperature are the same; i.e., the hydrocarbon has a single boiling point. In such a case, the boiling point of the hydrocarbon must be at least about 350° F. in order to meet the requirement of a 5 volume percent distillation temperature of at least about 250° F. and a 95 volume percent distillation temperature of at least about 350° F. The promoter liquid is preferably a blend or mixture of hydrocarbons in which case the 5 volume percent and 95 volume percent distillation temperatures are not the same.

The 5 volume percent and 95 volume percent distillation temperature may be conveniently determined by ASTM No. D 86-67 or No. D 1160 with the former being preferred for those liquids having a 95 percent volume distillation temperature below 600° F. and the latter for those above 600° F. The methods for determining such temperatures are well known in the art and further details in this respect are not required for a full understanding of the invention. It is also to be understood that the reported temperatures are corrected to atmospheric pressure.

As representative examples of such liquids, there may be mentioned: kerosene or kerosene fraction from paraffinic or mixed base crude oils; middle distillates, light gas oils and gas oil fractions paraffinic or mixed based crude oils; alkyl benzenes with side chains containing 10 or more carbon atoms; paraffinic hydrocarbons containing more than 12 carbon atoms; white oils or white oil fraction derived from crude oils; alphaolefins containing more than 12 carbon atoms; fully hydrogenated naphthalenes and substituted naphthalenes; propylene oligomers (pentamer and higher); tetrahydronaphthalene, heavy naphtha fractions, etc. The most preferred liquids are kerosene fractions; white oils; fully hydrogenated naphthalenes and substituted naphthalenes; and tetrahydronaphthalene.

In the case of coal tar pitch, the non-crystalline substances are measured as quinoline insolubles, and in accordance with the present invention, the liquid promoter is added in an amount sufficient to effect separation of a coal tar pitch fraction which is essentially free of quinoline insolubles; i.e., the recovered coal tar pitch fraction contains less than about 0.5 weight percent of quinoline insolubles, preferably less than about 0.1 weight percent of quinoline insolubles. At the upper limit, the addition of excesssive amounts of promoter liquid may result in excess separation of quinoline soluble components from the recovered coal tar pitch fraction and, accordingly, such excess amounts should be avoided. In general, the promoter liquid is added to the coal tar pitch in an amount to provide a promoter liquid to coal tar pitch weight ratios of from about 0.1:1 to about 3.0:1, with the weight ratio preferably being from about 0.2:1 to about 0.5:1 when the promoter liquid has a characterization factor of from 10.5 to 11.0.

The quinoline insoluble components are separated from the coal tar pitch at a temperature in the order of from about 230° C. to about 315° C. and preferably from about 260° to about 288° C. The quinoline insolubles can be separated by any one of a wide variety of separation techniques; e.g., filtration, centrifugation, settling, etc. However, in accordance with the preferred embodiment of the present invention, such separation of quinoline insolubles in the presence of a promoter liquid is effected by gravity settling with a coal tar pitch, which is essentially free of quinoline insolubles being recovered as an overflow, and a coal tar pitch fraction, containing the quinoline insolubles, being recovered as an underflow.

In accordance with the present invention, it is possible to recover in the quinoline insoluble free fraction a substantial portion of the non-distillable quinoline soluble components which can be converted to needle coke. In particular, it is possible to recover in excess of 65% of the non-distillable quinoline soluble components present in the coal tar pitch as an essentially quinoline insoluble free fraction, with such recovery generally being in the order of from 50% to 85%, or greater.

The recovered treated coal tar pitch fraction, after separation of promoter liquid therefrom is then coked to a needle coke, preferably by a delayed coking technique, although other coking techniques are also possible.

The recovered fraction containing the non-crystalline substances, after separation of promoter liquid therefrom, may also be coked to produce an anode grade coke. Alternatively, such fraction may be employed for coke oven charge blending, fuel or the like.

In accordance with one embodiment of the present invention, the coal tar pitch fraction, which is essentially free of quinoline insolubles, is treated prior to effecting coking thereof to separate nitrogen heterocyclic compounds therefrom by procedures known in the art. In particular, partial removal of nitrogen heterocyclics can be effected by treatment with sulfuric acid to convert the nitrogen heterocyclics to water soluble sulfates which are separated with the water phase. The sulfated hydrocarbons are treated with caustic or ammonia to convert the materials to hydrocarbons which are separated from the water phase.

In accordance with another embodiment of the present invention, a coal tar derived binder pitch is treated with the promoter liquid in the manner hereinabove described with reference to coal tar pitch, to provide a coal tar derived pitch having reduced quinoline insolubles. Thus, for example, in one steel plants, in which coking coal is introduced into carbonization ovens, the coal tar binder pitch produced as a carbonization byproduct has an increased quantity of quinoline insolubles as a result of entrainment and carry-over of fine coal and coke particles. The treatment of such coal tar derived binder pitches in accordance with the present invention to reduce quinoline insolubles improves the binder quality of such pitches.

The invention will be further described with respect to the accompanying drawing, wherein:

The drawing is a simplified schematic flow diagram of an embodiment of the present invention.

It is to be understood, however, that the present invention is not to be limited by the hereinafter described specific embodiment.

Referring now to the drawing, a coal tar pitch in line 10 is combined with a liquid promoter in line 11 of the type hereinabove described. The combined stream in line 12 is introduced into a separation zone 13 in order to separate a coal tar pitch fraction, which is essentially free of quinoline insolubles, from a coal tar pitch fraction, containing the quinoline insolubles. As hereinabove noted, the separation zone 13 is preferably a gravity settling zone, containing one or more gravity settlers, whereby the coal tar pitch fraction, which is essentially free of quinoline insolubles, is recovered as an overflow, with a coal tar pitch fraction, containing the quinoline insolubles, and also some quinoline solubles, being recovered as an underflow.

The coal tar pitch fraction which is essentially free of quinoline insolubles, and which also contains promoter liquid is withdrawn from separation zone 13 through line 14 and introduced into a fractionator, schematically indicated as 15, in order to recover the promoter liquid therefrom. An overhead of promoter liquid is withdrawn from fractionator 15 through line 16 combined with make-up in line 17 and recycled for mixing with the coal tar pitch through line 11.

A coal tar pitch fraction, essentially free of quinoline insolubles is withdrawn from, fractionator 15 through line 21 and introduced into a coker combination fractioning tower 22 of a type known in the art.

In accordance with a preferred embodiment, the coal tar pitch fraction, which is essentially free of quinoline insolubles, is introduced into a heterocyclic separation zone, schematically indicated as 23, wherein, as hereinabove described, heterocyclic compounds are separated from the coal tar pitch fraction. The coal tar pitch fraction which is now free of both quinoline insolubles and heterocyclic compounds is withdrawn from separation zone 23 through line 24 for introduction into the coker combination fractionator 22.

The coker combination fractionating tower 22 is operated as known in the art to recover a gas fraction, a distillate fraction, a light oil fraction and a heavy oil fraction.

A cokeable bottoms product, having an initial boiling point of 290° to 430° C. is withdrawn from coker combination fractionating tower 22 through line 31 and passed through a coking heater 32 as known in the art wherein the fraction is heated to a temperature in the order of from about 454° C. to about 515° C. The heated fraction in line 33 introduced into a coking drum 34 wherein the fraction is delayed coked to needle coke. In general, as known in the art, such coking drums are operated at a pressure of from about 1.05 kg/cm$^2$ (g) to about 6.3 kg/cm$^2$ (g), preferably from about 1.8 to 6.3 kg/cm$^2$ (g) and at an overhead temperature of from about 412° C. to about 475° C. and preferably from about 460° C. to about 475° C. The coke is withdrawn from the drum 34 through line 35.

An overhead is withdrawn from the coke drum 35 through line 36, and such overhead is introduced into the coker combination fractionator 22 to recover various fractions therefrom, as known in the art.

A coal tar fraction containing the quinoline insolubles, as well as quinoline solubles and promoter liquid is withdrawn from separation zone 13 through line 41 and introduced into a fractionator 42 to separate the promoter liquid therefrom. The separated promoter liquid is withdrawn from fractionator 42 as an overhead through line 43 for combination with the recycled promoter liquid in line 11.

A coal tar pitch bottoms is withdrawn from fractionator 42 and may be employed, for example, for the production of anode-grade coke.

Alternatively, the quinoline insolubles containing coal tar pitch fraction withdrawn through line 41 may be introduced through line 46 into a flash distillation zone, schematically indicated as 47, to recover promoter liquid, as overhead through line 48, and a fraction boiling from about 315° C. to about 565° C., as a sidestream through line 49, with the sidestream in line 49 being employed as additional feed for the production of needle coke.

The remaining heavy fraction, withdrawn as bottoms through line 51 may be employed for the production of, for example, anode-grade coke.

The invention will be further described with respect to the following example; however, the scope of the invention is not to be limited thereby.

EXAMPLE

A coal tar pitch having the properties of Table I is admixed with a promoter liquid having a characterization factor of 10.8, an initial distillation temperature of 200° C. and end point of 268° C. to provide 30 kg of promoter liquid per 100 kg of coal tar pitch.

TABLE 1

| | |
|---|---|
| Softening Point | 83° C. |
| Quinoline Insolubles | 16 wt. % |
| Benzene Insolubles | 30 wt. % |
| Asphaltenes | 35 wt. % |
| Conradson Carbon Residue | 48 wt. % |
| Amount Boiling Below 427° C. | 10 wt. % |
| Initial Boiling Point | 315° C. |

The mixture is introduced into a gravity settler and the results are as follows:

| Component | Feed kg | Overflow kg | Underflow kg |
|---|---|---|---|
| Promoter Liquid | 30.0 | 19.5 | 10.5 |
| Quinoline Solubles (−427° C.) | 10.0 | 6.5 | 3.5 |
| Quinoline Solubles (+427° C.) | 74.0 | 48.2 | 25.8 |
| Quinoline Insolubles (+427° C.) | 16.0 | — | 16.0 |

After separation of promoter liquid, the overflow is delayed coked to produce a high quality needle coke in a yield of 35–42%.

The present invention is particularly advantageous in that it is possible to produce a high quality needle coke in high yields. Thus, for example, high yields of needle coke from coal tar pitch are made possible by the high recovery of non-distillable components which are essentially free of quinoline insolubles. Thus, in accordance with the present invention, it is possible to recover in excess of 65% of the non-distillable quinoline soluble components present in the coal tar pitch, which components are convertible to needle coke.

Numerous modifications and variations of the present invention are possible in light of the above teachings and, therefore, within the scope of the appended claims, the invention may be practiced otherwise than as particularly described.

What is claimed is:

1. A process for reducing the quinoline insoluble content of a coal derived binder pitch, comprising:

contacting a coal tar derived binder pitch feed with a liquid promoter which enhances and promotes the separation of quinoline insolubles, said liquid promoter being a hydrocarbon liquid having a 5-volume percent distillation temperature of at least about 250° F. and a 95-volume percent distillation temperature of at least about 350° F. and no greater than about 750° F., said liquid having a characterization factor of at least 9.75, said liquid promoter being added in an amount to provide a promoter liquid to binder pitch weight ratio of from 0.2:1 to 0.5:1 which is sufficient to recover by gravity settling an overflow stream containing a coal derived binder pitch having less than 0.5 weight percent of quinoline insolubles and in excess of 65% of the non-distillable quinoline soluble components present in the binder pitch feed;

recovering by gravity settling as an overflow stream a mixture of promoter liquid and a coal tar derived binder pitch fraction having less than 0.5 weight percent of quinoline insolubles and in excess of 65% of the non-distillable quinoline soluble components present in the binder pitch feed; and separating said coal tar derived binder pitch fraction from the promoter liquid.

2. The process of claim 2 wherein the promoter liquid is at least one member selected from the group consisting of kerosene, kerosene fractions, middle distillates, light gas oils, gas oil fractions, heavy napthas, white oils and white oil fractions from crude oils.

3. The process of claim 2 wherein the said promoter liquid has a characterization factor of less than 12.

4. The process of claim 3 wherein the said promoter liquid has a characterization factor of from 10.5 to 11.0.

5. The process of claim 1 wherein the contacting is effected at a temperature of from 230° C. to 315° C.

* * * * *